United States Patent [19]

Boykin, Jr.

[11] 3,970,144

[45] July 20, 1976

[54] SUBSURFACE SHUTOFF VALVE AND CONTROL MEANS

[76] Inventor: Robert O. Boykin, Jr., P.O. Box 5151, Midland, Tex. 79701

[22] Filed: Aug. 11, 1975

[21] Appl. No.: 603,306

[52] U.S. Cl. ..... 166/53; 166/72; 166/224 A; 251/5

[51] Int. Cl.[2] ..... E21B 43/12

[58] Field of Search ..... 166/53, 72, 224 R, 128; 251/5

[56] References Cited

UNITED STATES PATENTS

| | | | |
|---|---|---|---|
| 3,338,310 | 8/1967 | McGill | 166/128 |
| 3,396,448 | 8/1968 | Kisling | 251/5 |
| 3,494,588 | 2/1970 | Kisling | 251/5 |
| 3,703,213 | 11/1972 | Kammerer et al. | 251/5 |

*Primary Examiner*—James A. Leppink
*Attorney, Agent, or Firm*—Lyon & Lyon

[57] ABSTRACT

A shutoff valve and control means particularly adapted for subsurface use in oil or gas wells, the shutoff valve being in the form of a sleeve having both circumferential and pre-stressed-longitudinal reinforcing, so arranged as to permit radial contraction of the sleeve under external closing pressure until passage therethrough is completely closed, while preventing rupture of the sleeve from pressure differential, between either its ends or its exterior and interior; the shutoff valve, being controlled by a set of four control valves and a pressure-fluid reservoir, both adjacent to the shutoff valve, is connected to the surface by a control line and a vent line; the set of control valves comprising an emergency-delivery valve, a overriding-delivery valve, a low-pressure vent-valve, and a high-pressure vent-valve.

15 Claims, 8 Drawing Figures

G
G
V
R
V
V
V
V
V
V
31
32
33
34
34
35
58
58
59
9
9
9
29
30
25
38
36
37
39
53
54
55
40
41
42
43
44
45
46
47
48
49
50
51
52
56
57
26
28
1
27

SUBSURFACE SHUTOFF VALVE AND CONTROL MEANS

BACKGROUND AND SUMMARY OF THE INVENTION

As the number of oil and gas wells completed in sensitive environments has increased so has the need to provide a dependable shutoff valve, for use in subsurface well tubing and in other critical locations, and to provide for adequate testing of such a valve, to make more certain that it will close when required to do so in an emergency.

The present invention is directed to a subsurface shutoff valve in the form of a sleeve and control means, which is summarized in the following objects:

First, to provide a sleeve type of shutoff valve the sleeve of which provides, when open, an unobstructed flow passage of maximum internal diameter for a given external sleeve diameter and is surrounded by a peripheral control chamber which, when pressurized, causes the valve to effect a full seal;

Second, to provide a sleeve type shutoff valve the sleeve of which is formed of readily deformable elastomeric material and is provided with novel reinforcing so arranged that, when subjected to external pressure to close the valve, the reinforcing limits axial displacement of the elastomeric material even when the valve is subjected to an extreme pressure differential between its ends.

Third, to provide a shutoff valve, as indicated in the preceding objects, and control means therefore embodying a pressure-fluid reservoir as well as novelly arranged control valves connected to the surface through control and vent lines.

Fourth, to provide a shutoff valve and control means, as indicated in the preceding objects, in which the control means causes the shutoff valve to close automatically in the event of either surface damage at the wellhead that ruptures the control line or the development of a leak in the control line.

Fifth, to provide a shutoff valve and control means, as indicated in the other objects, whereby at regular intervals or at any other time the high-pressure reservoir can be checked for adequate pressure and if necessary replenished from a reserve surface supply of high-pressure fluid.

Sixth, to provide a shutoff valve and control means whereby the shutoff valve may be operated manually from the surface.

DESCRIPTION OF THE PREFERRED EMBODIMENT

Figures 1, 2:
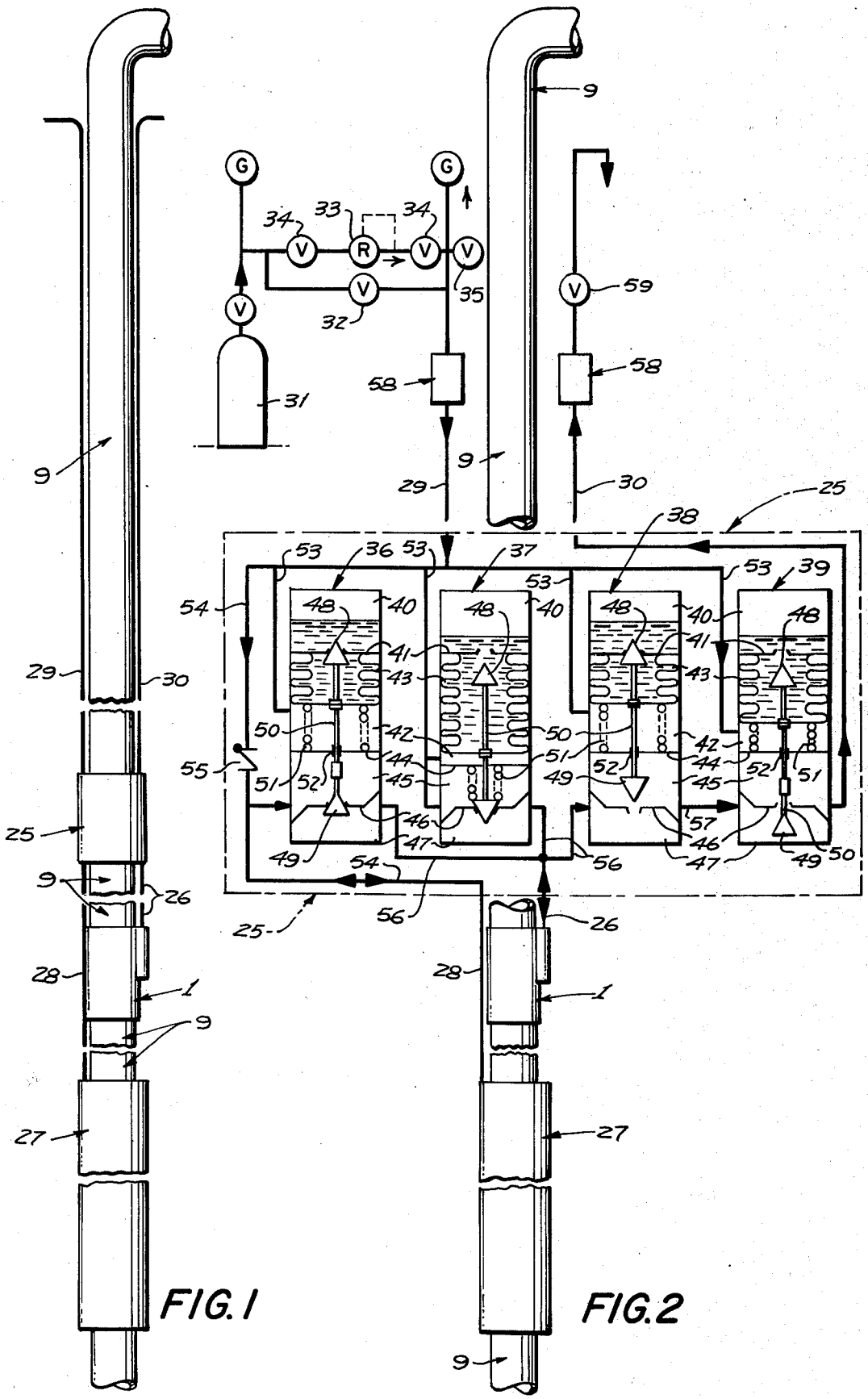
FIG. 1 is an essentially diagrammatical view of a tubing string provided with the subsurface shutoff valve and control means, illustrating the relative position of the major components.
FIG. 2 is a similar view of the tubing string, showing diagrammatically the internal mechanism provided in the control valve housing, and also indicating diagrammatically the surface equipment utilized in the control means.
Figure 3:
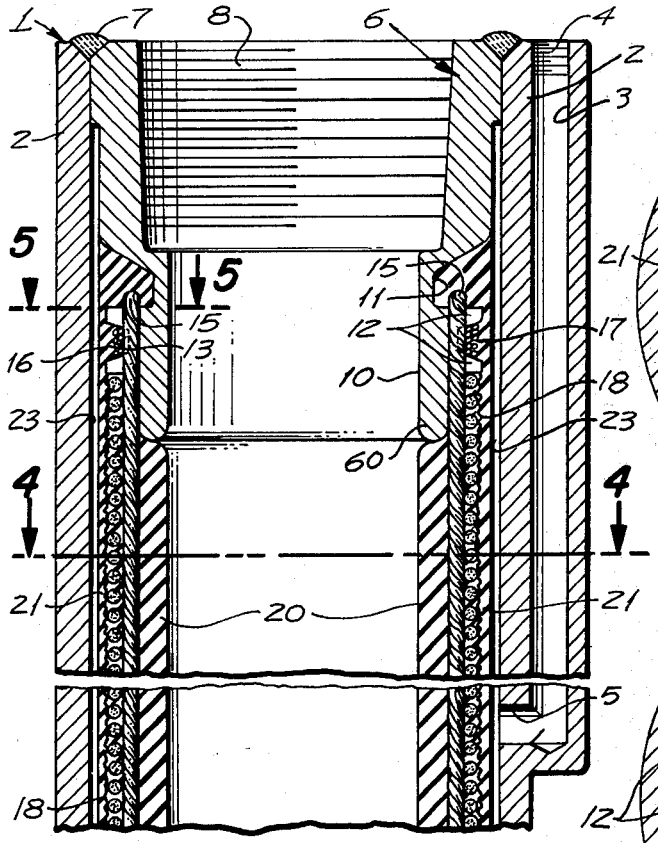
FIG. 3 is a fragmentary longitudinal sectional view of the shutoff valve shown in its open position.
Figure 4:
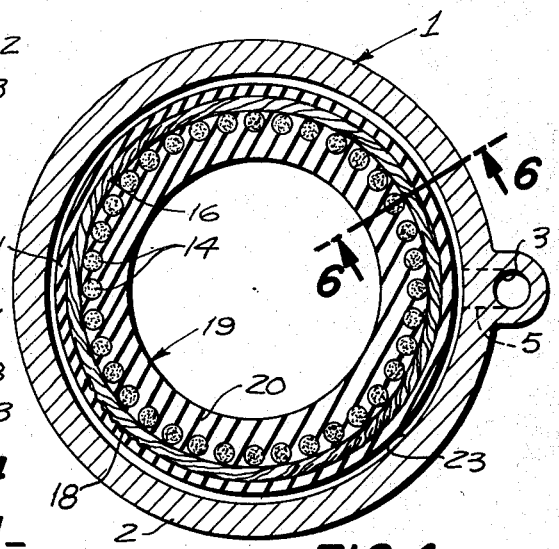
FIG. 4 is a transverse view taken at section 4—4 of FIG. 3.
Figure 5:
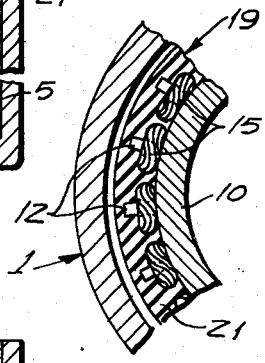
FIG. 5 is a fragmentary transverse view taken at section 5—5 of FIG. 3, with the end-loops in the pre-stressed longitudinal reinforcing cord exposed.
Figure 6:
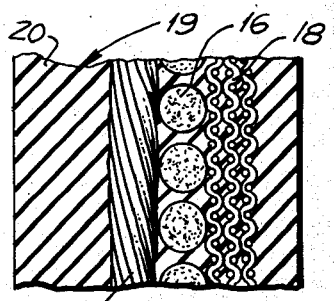
FIG. 6 is an enlarged fragmentary transverse view taken at section 6—6 of FIG. 4.
Figure 7:
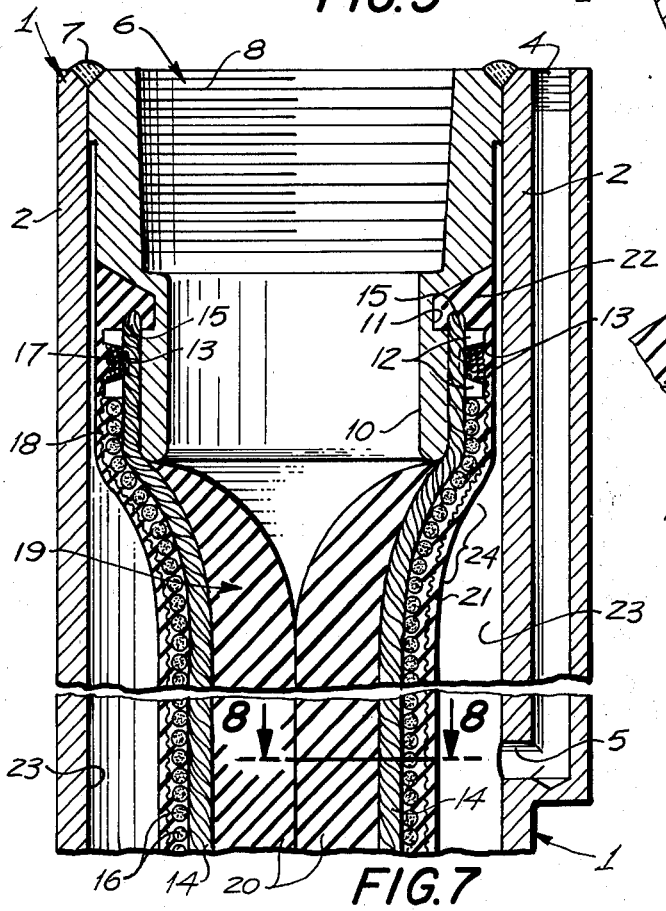
FIG. 7 is a fragmentary longitudinal sectional view corresponding to FIG. 3 but showing the valve in the closed, or shutoff, condition.

Reference is first directed to FIGS. 3 through 8 which show the shutoff valve designated generally by 1. The shutoff valve includes a housing 2 which is cylindrical and is provided with a small pressure fluid supply duct 3 extending axially along the housing. The supply duct is provided with an entrance end 4 at the upper end of the housing and an inlet port directed into the housing at its midportion.

The ends of the housing 2 receive end collars 6 which are joined and sealed to the housing by means of welds 7. The end collars are provided with internal screw threads 8 so that the shutoff valve may be interposed in a tubing string 9.

Continuing from each collar 6 is a short tubular stem 10 spaced from the inner wall of the housing. Adjacent the corresponding collar 6 each tubular stem is provided with an outwardly directed peripheral channel 11. Adjacent the channel 11 each tubular stem is provided with a peripheral set of radially projecting rib elements or prongs 12 which are divided into pairs by the outwardly directed peripheral channel 11. The middlemost extremity of each tubular stem 10 terminates in a lip 60, which is rounded to a maximal radius for the purpose of minimizing bending stresses in the closed sleeve and its reinforcing, particularly in the pre-stressed longitudinal reinforcing cord 14.

The reinforcing cord 14 is strung longitudinally between the two sets of projecting rib-elements 12. It is pre-stressed, i.e., optimally tensioned during installation, and is folded over the axial extremities of the two sets of projecting rib-elements, forming the U-shaped end-loops 15. The two extremities of the pre-stressed reinforcing cord 14 are joined together near the midportion of the sleeve by suitable means, not shown. When looped over the projecting rib-elements 12, the reinforcing cord 14 forms a plurality of parallel longitudinally extending pre-stressed reinforcing elements. Wrapped about these pre-stressed longitudinal elements is a helical reinforcing cord 17 and wrapped about this helical reinforcing 17 are several convolutions of reinforcing fabric 18. This fabric extends at each end to cover the pre-stressed longitudinal reinforcing elements where they cross the channel 11. The fabric is bound within the channel 11 by being tightly wrapped with the circumferential retainer cord 16. The cords 14, 16, and 17 and the fabric 18 are formed of high strength plastic material or maybe fiberglass or maybe steel strands or a mixture of steel strands with the plastic or glass fiber strands.

The cords 14, 16 and 17 and the fabric 18 are molded within a tubular sleeve 19 formed of rubber or other elastomeric material. This sleeve has approximately the same internal diameter as that of the tubular stems 10, and forms a substantial inner lamination 20 extending between the stems 10. The sleeve also includes an outer lamination 21 encompassing the reinforcing. Also, the sleeve includes end portions 22 which extend over the tubular stems 10 and into the channels 11 and 13, and completely surround the ribs 12. The exterior of the sleeve 19 forms with the interior of the housing 2 an annular control-chamber 23.

The housing 2 withstands the various stresses arising from its being interposed in and part of the tubing string 9, and in addition withstands the pressure exerted by the pressure fluid in the annular control-chamber 23 and the axial compression exerted through the end collars 6 by the plurality of pre-stressed longitudinal elements that comprise the reinforcing cord 14.

Figure 8:
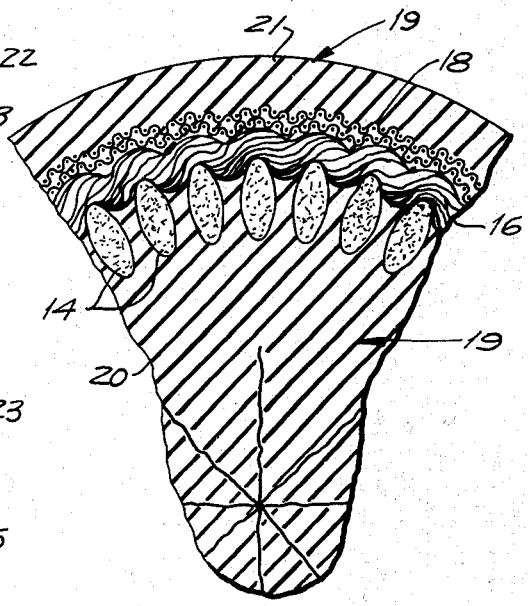
FIG. 8 is an enlarged fragmentary transverse view taken at section 8—8 of FIG. 7.

Operation of the shutoff valve is as follows:

The inside diameter of the sleeve 19 is essentially the same as the internal diameter of the tubing string 9 in which the shutoff valve is founded. Thus under normal flow conditions the sleeve functions merely as a length of tubing, without increased flow resistance. The distance between the tubular stems 10 is on the order of one foot or more. By reason of the reinforcing a substantial excess of external pressure over internal pressure is required to compress the sleeve radially inward. When pressure fluid at such required excess pressure is applied through the duct 3, the inner lamination 20 contracts and folds upon itself as indicated in FIG. 8 until the midportion of the sleeve forms a closed cylinder. As the external pressure increases, the typical cross-section of the pre-stressed longitudinal reinforcing cord 14 compresses circumferentially and expands radially, as indicated in FIG. 8, and the helical reinforcing as well as the fabric reinforcing tend to assume a corrugated form. Adjacent to each tubular stem 10 in the closed sleeve there is formed a diameter-transition zone 24, along which the axial aperture varies from fully closed to fully open and in which the longitudinal reinforcing 14 is formed into a bell shape with an arched profile. This curvature permits the reinforcing in this zone to both support the sleeve 19 against the collapsing effect of the excess of external over internal pressure and anchor the sleeve against any substantial axial displacement, even though the pressure differential between the two ends of the sleeve may be extremely high.

Reference is now made to FIGS. 1 and 2, in which the shutoff valve 1 is shown interposed in the tubing string 9. Interposed in the tubing string above the shutoff valve is an annular housing 25 for the control valves, which is joined by a connecting line 29 to the pressure fluid supply 31. Interposed in the tubing string 9 below the shutoff valve is an annular subsurface pressure-reservoir 27 joined by a connecting line 28 to the control-valve housing 25. Extending upwardly from the control-valve housing 25 to the surface of the well is a control line 29 and a vent line 30. At the surface the control line is connected to a pressure tank 31 through a valve 32 and is also connected to the pressure tank through a bypass line having a regulator 33 and isolation valves 34. The control line 29 is also provided with a bleed valve 35. To facilitate the control and operation of the subsurface equipment both the control line 29 and the vent line 30 are provided at the the surface with indicating flow meters 58, of the rotameter or orifice-meter type. The vent line 30 is also provided with an emergency closure valve 59, which is normally sealed and locked in the open position.

Within the control-valve housing are four control valves, comprising an emergency valve 36, an overriding delivery valve 37, a low-pressure vent-valve 38, and a high-pressure vent-valve 39. As the volume of pressure fluid that must pass through the duct 3 in order to close the shutoff valve is relatively small, the various pressure fluid lines may be of small diameter and the four control valves 36, 37, 38 and 39 may also be of small diameter, so that they may be fitted into the annular housing 25, spaced equally around its central passage-way for the tubing string 9.

The valves contained in the control valve housing may be similar in most respects. Each valve includes a charging chamber 40 separated by an upper bulkhead 41 from a bellows chamber 42 containing a bellows 43 which is joined to the upper bulkhead 41. Each bellows chamber 42 is separated by a middle bulkhead 44 from an upper flow-chamber 45 which in turn is separated by a lower bulkhead 46 from a lower flow-chamber 47.

The bellows 43 in each control valve contains an upper valve element 48 which moves upwardly to close the port in the upper bulkhead 41. Each control valve is also provided with a lower valve-element 49. In control valves 36 and 39 this element 49 is located in the lower flow-chamber 47, so that upward movement of the element will close the port in the lower bulkhead 46. In control valves 37 and 38, however, the lower valve element 49 is located in the upper flow-chamber 45 and moves downward to close the port in the lower bulkhead 46. In all four control valves the upper and lower valve elements 48 and 49 are joined by a valve stem 50. Each of these valve stems is provided with a spring 51 which in control valves 36, 38 and 39 extends between the middle bulkhead 44 and the bellows 43, whereas in control valve 37 the spring extends between the middle bulkhead 44 and the lower valve element 49. In every case the valve stem 50 is sealed where it penetrates the bellows 43. The middle bulkhead 44 in control valves 36, 38 and 39 is provided with a packing gland 52 to seal the valve stem 50, but this seal is not necessary in control valve 37.

Branch lines 53 extend from the control line 29 to each of the bellows chambers 42. In control valve 37 this line also connects to the upper flow chamber 45. There is also a branch line 54 from the control line 29 to the connecting line 28, which extends to the reservoir 27. The branch line 54 is connected to the flow chamber 45 in control valve 36, and includes the check valve 55 to prevent backflow from the reservoir 27 to the control line 29. A cross line 56 connects the chambers 47 of valves 36, 37 and 38. The cross line 56 is joined to connecting line 26 leading to the pressure fluid supply duct 3. Another cross-line 57 extends between flow chamber 45 of valve 38 and flow chamber 47 of valve 39.

The surface pressure-tank 31 is maintained at a pressure above that required to close the shutoff valve 1. This tank pressure must substantially exceed the pressure in the well tubing at the shutoff valve 1. High pressure fluid is delivered from the tank 31 through line 29, branch line 54 through check valve 55 to line 28 and the reservoir 27. In all of the control valves the bellows 43 and the lower portion of the charging chamber 40 are filled with an inert liquid. The upper portion of the charging chamber is filled with inert gas to an accurately measured charging pressure. In control valves 36, 38 and 39 the charging pressure is below the constant maintenance pressure that is normally sustained by the pressure regulator 33, or may be essentially equal to such maintenance pressure due to the presence of the springs 51. In control valve 37 the charging pressure is commensurate with that in the reservoir 27.

The control line 29 and the chambers 42 surrounding the bellows 43 are normally pressurized at the maintenance pressure, for example 300 pounds per square inch, this being sufficient to hold the upper and lower valve elements 48 and 49 of valve 36 in a closed position and to hold valve element 48 in valve 38 in a closed position. Valve 38, however, is constructed so that in this condition of valve element 48 the valve element 49 is in an open position. The chamber 40 of valve 39 is pressurized to a point above the maintenance pressure, so that the pressure in its chamber 40 is sufficient to hold both of its valve elements 48 and 49 in open position.

The maintenance pressure that is normally present in the control line 29 is sufficient to hold valve element 49 of valve 36 in its closed position, as the effective area of the valve element 49 is substantially less than the effective area of the corresponding bellows 43. Under these conditions there is no release of pressure fluid from the reservoir 27. Should the pressure in the control line 29 be substantially reduced below the maintenance pressure, either deliberately or by an accident, such as damage to the upper region of the tubing string to which the line 29 is attached, the resulting reduction in the seating force exerted upward by the control-line pressure on the bellows 43 will cause the opening forces exerted downward by the charging pressure against the bellows and by the reservoir pressure against the valve element 49, to predominate and thereby open the valve element 49, thus connecting the reservoir 27 to the shutoff valve 1. The drop in pressure in the control line 29 causes the valve element 49 of valve 38 to close and prevent the escape of pressure fluid through the vent line 30. Meanwhile the valve element 49 of valve 39 remains open, but with no effect, since valve 38 is closed. The pressure fluid reaching the control chamber of the shutoff valve 1 closes it by acting upon the tubular valve body 19.

Whenever the maintenance pressure is subsequently restored control valve 36 closes off the flow of pressure fluid from the reservoir 27, the pressure fluid trapped in the shutoff valve is vented by the opening of valve 38, and the shutoff valve 1 then opens.

Should it be desired to operate the shutoff valve 1 directly without use of the pressure fluid from the reservoir 27, the control line 29 is connected directly to the pressure tank 31 which provides sufficient pressure to cause valve element 49 of valve 37 to open connecting the control line 29 directly to the line 26 and the supply duct 3 of the shutoff valve. Such high pressure closes valve element 49 of valve 39 so that the high pressure may be maintained. When it is desired to reopen the valve 1, the bleed valve 35 is opened permitting the control-line pressure to drop to the maintenance pressure, at which pressure valve 39 opens first, followed by valve 1.

Although the shutoff valve 1 is intended primarily for full-bore shutoff it may also be used for annular shutoff, in case the bore of the shutoff valve is occupied when it is closed by some such object as a rod, wire, cable, or tube.

Having fully described my invention it is to be understood that I am not to be limited to the details herein set forth, but that my invention is of the full scope of the appended claims.

I claim:

1. A shutoff control system for a producing string extending within a well bore, comprising:

a. a shutoff valve interposed in the producing string, the valve including a control chamber which, when subjected to a pressure that exceeds the internal pressure by a preselected differential, causes the shutoff valve to close, so as to stop all flow through the producing string;

b. a pressure fluid reservoir carried by the producing string, connected to the shutoff valve control-chamber and having a pressure-fluid capacity capable of pressurizing the shutoff valve control chamber sufficiently to effect closure of the shutoff valve;

c. a control line extending from the reservoir to the surface, at or near the wellhead;

d. a source of pressure fluid connectable to the control line for supplying pressure fluid to the reservoir;

e. a check valve preventing return flow of pressure fluid from the reservoir;

f. and a valve means interposed between the reservoir and the shutoff-valve control-chamber for supplying pressure fluid to the shutoff-valve control-chamber in the event of loss of pressure in the control line.

2. A control system as defined in claim 1, wherein:

a. a control means, carried by the tubing string in proximity to the shutoff valve, is interposed in the control line and includes said valve means, the control means also including further valve means connected to the shutoff-valve control-chamber, said further valve means being responsive to pressure in excess of that supplied by the reservoir to bypass the reservoir and effect closure of the shutoff valve.

3. A control system as defined in claim 2, wherein:

a. a vent line extends from the control means to the surface, at or near the wellhead;

b. and vent-valve means within the control means is connected to the control line and vent line to minimize back pressure.

4. A control system as defined in claim 1, wherein:

a. the shutoff valve includes a normally tubular sleeve, the control chamber surrounds the sleeve, and the sleeve closes radially inwardly.

5. A shutoff valve control-system for a producing string extending within a well bore, comprising:

a. a shutoff valve interposed in the producing string, the valve including a control chamber which, when subjected to pressure exceeding a predetermined amount, closes the shutoff valve to flow through the producing string;

b. a pressure-fluid reservoir carried by the tubing string and having sufficient capacity to close the shutoff valve;

c. a control means also carried by the tubing string in proximity to the shutoff valve;

d. a control line extending from the reservoir through the control means to the surface, at or near the wellhead;

e. a check valve for preventing back flow from the reservoir to the control line;

f. means at the surface for supplying fluid to the control means at a maintenance pressure, at a first operating pressure for delivery to the reservoir and at a second higher operating pressure;

g. a connecting line between the control means and the shutoff-valve control-chamber;

h. a first valve means in the control means operable to connect the reservoir with the shutoff-valve control-chamber upon drop in said maintenance pressure, to effect closure of the shutoff valve;

i. and a second valve means in the control means responsive to said second operating pressure to connect the shutoff-valve control-chamber with the control line and also to effect closure of the shutoff valve.

6. A control system as defined in claim 5, wherein:

a. a vent line extends from the control means to the surface;

b. a vent-valve means is connected to the shutoff-valve control-chamber and maintained in an open position when said maintenance pressure is present in the first and second valve means, to prevent build up of back pressure tending to reduce the effect of the maintenance pressure;

c. said vent-valve means being adapted to close upon any substantial drop in the maintenance pressure, so as to prevent loss of pressure in the control chamber when the shutoff valve is closed;

d. and said vent-valve means is adapted to reopen upon restoration of the maintenance pressure.

7. A control system as defined in claim 6, wherein:

a. said shutoff valve includes a sleeve formed of tubular elastomeric material including a reinforcing means which comprises both circumferential and pre-stressed-longitudinal reinforcing;

b. said control chamber is annular and surrounds the shutoff-valve sleeve for effecting radially inward compression of the sleeve;

c. the reinforcing means prevents axial extrusion of the sleeve when its central portion is radially compressed inward to effect valve closure and the sleeve is also subjected to a large pressure differential between its ends;

d. and the reinforcing means prevents inward rupture of the end portions of the sleeve when its central portion is radially compressed inward to effect valve closure and each of said end portions is subjected to a large differential between the external closing pressure and a smaller internal pressure.

8. A shutoff valve for a tubing string extending within a well bore, comprising:

a. a tubular housing having annular fittings at opposite ends for interposed connection to a tubing string;

b. annular means disposed axially inward from each fitting having a peripheral set of radially outwardly projecting rib elements forming axially remote extremities;

c. a pre-stressed reinforcing cord extending longitudinally between the sets of rib elements and looped about the rib elements at each end so as to form a peripheral set of pre-stressed reinforcing elements parallel to the axis of the shutoff valve;

d. a reinforcing means wrapped about the first reinforcing cord;

e. a tubular member formed of elastomeric material impregnating the reinforcing cord and extending radially inwardly and radially outwardly therefrom, and including end portions surrounding the annular means;

f. the outer periphery of the tubular member forming with the housing an annular control chamber adapted to receive pressure fluid to effect radially inward pressure on the tubular member so as to compress the mid-portion of the tubular member, causing said mid-portion to form a solid cylinder shutting off flow therethrough;

g. the reinforcing cord, reinforcing means and tubular member forming, on compression of the tubular member, diameter-transition zones adjacent to each of its ends, between its solid-cylinder mid-portion and these ends, wherein the reinforcing cord and reinforcing means are essentially conical or bell-shaped and restrain the tubular member against either substantial axial displacement in response to pressure differential between the axial ends thereof or inward rupture, caused by pressure differential between the exterior and the interior of the sleeve in said diameter-transition zones.

9. A shutoff valve as defined in claim 8, wherein:

a. the reinforcing means includes a helical wrapped cord externally of the longitudinally extending cord.

10. A shutoff valve as defined in claim 8, wherein:

a. the reinforcing means includes circumferential wrappings of fabric material.

11. A shutoff valve as defined in claim 8, wherein:

a. the ribs of each of the annular means define an annular channel;

b. and a multiple wrapping of strands secure the axial end portions of the reinforcing cord in wrapped relation with the radial ribs.

12. A shutoff valve for a tubing string extending within a well bore, comprising:

a. a tubular housing having annular fittings at opposite axial ends for interposed connection to a tubular string;

b. tubular elements disposed axially inward from the fittings and fixed against axial displacement;

c. a sleeve of elastomeric material extending between and covering the tubular elements, the end portions of the sleeve and tubular elements having mating grooves and channels to secure the sleeve against substantial axial movement;

d. the sleeve forming with the surrounding housing an annular pressure chamber adapted to receive pressure fluid for compressing the sleeve radially and cause the central portion of the sleeve to form a solid cylinder shutting off flow through the sleeve;

e. and longitudinally and circumferentially extending reinforcing means imbedded in the sleeve to cause the sleeve under high external pressure to form a diameter-transition zone adjacent to each tubular element, wherein the reinforcing means is essentially conical or bell-shaped and causes the sleeve to resist both axial loads caused by pressure differential between its axial ends when the central portion is closed and radially inward collapsing loads in the diameter-transition zones, caused by a differential between the external closing pressure and the internal pressure or pressures.

13. A shutoff valve as defined in claim 12, wherein:

a. each tubular element includes a set of radiating ribs;

b. the longitudinal reinforcing include axial extremities looped about the radiating ribs and held under tension stress between the tubular elements.

14. A shutoff valve as defined in claim 12, wherein:

a. each set of radiating ribs forming a circumferential channel adjacent the axial extremities of the longitudinal reinforcing;

b. and a tie strand received in the channel encompasses and restrains the reinforcing.

15. A shutoff valve as defined in claim 12, wherein:

a. each of the tubular elements disposed axially inward from the annular fitting terminates at its inward extremity in a lip that is maximally rounded, so as to minimize bending stresses in the sleeve and its reinforcing where the sleeve in closing bends across the lip.

* * * * *